US007849639B2

(12) United States Patent
Sprung

(10) Patent No.: US 7,849,639 B2
(45) Date of Patent: Dec. 14, 2010

(54) STRESSED MEMBRANE STRUCTURE

(75) Inventor: Philip Davis Sprung, Alberta (CA)

(73) Assignee: Sprung Instant Structures Ltd., Alberta, Calgary (CA)

( * ) Notice: Subject to any disclaimer, the term of this patent is extended or adjusted under 35 U.S.C. 154(b) by 1123 days.

(21) Appl. No.: 10/980,063

(22) Filed: Nov. 2, 2004

(65) Prior Publication Data

US 2006/0101730 A1 May 18, 2006

(51) Int. Cl.

| | |
|---|---|
| ***E04B 7/00*** | (2006.01) |
| ***E04B 1/12*** | (2006.01) |
| ***E04B 1/00*** | (2006.01) |
| ***E04H 15/36*** | (2006.01) |

(52) U.S. Cl. ..... 52/82; 52/63; 52/222; 135/907; 135/908; 135/124

(58) Field of Classification Search ..... 52/222, 52/63, 82, DIG. 17; 135/907, 908, 124
See application file for complete search history.

(56) References Cited

U.S. PATENT DOCUMENTS

| | | | | | |
|---|---|---|---|---|---|
| 30,044 | A | * | 9/1860 | Huddle | 135/4 |
| 2,704,522 | A | * | 3/1955 | Frieder et al. | 52/641 |
| 2,999,278 | A | * | 9/1961 | Spencer et al. | 52/479 |
| 3,780,477 | A | * | 12/1973 | Sprung, Jr. | 135/124 |
| 4,118,904 | A | * | 10/1978 | Sprung | 52/63 |
| 4,137,687 | A | * | 2/1979 | Sprung | 52/745.07 |
| 4,229,914 | A | | 10/1980 | Lucas | |
| 4,519,175 | A | * | 5/1985 | Resan | 52/713 |
| 4,583,331 | A | * | 4/1986 | Hunt et al. | 52/2.17 |
| 4,593,710 | A | | 6/1986 | Stafford et al. | |
| 4,644,706 | A | | 2/1987 | Stafford et al. | |

(Continued)

FOREIGN PATENT DOCUMENTS

| | | |
|---|---|---|
| CA | 937479 | 11/1973 |

(Continued)

OTHER PUBLICATIONS

Universal Fabric Structures, Drawing—"Salt Enclosure Keder in Profile", Apr. 19, 1996.

(Continued)

*Primary Examiner*—Brian E Glessner
*Assistant Examiner*—Omar Hijaz
(74) *Attorney, Agent, or Firm*—Volpe and Koenig, P.C.

(57) ABSTRACT

A demountable building structure that is readily assembled from a set of components is disclosed. The building structure includes a plurality of arc frame members spaced along a length of the building structure. Each of the arc frame members extends from a first foot portion to a peak, and back to a second foot portion. Each of the arc frame members includes a plurality of beams. Each of the beams includes two opposed flanges. Each of the flanges has two bifurcated ends. The ends define c-shaped rope chases with openings. The building structure further includes bases slidably mateable with the first and second foot portions, and elongate membranes having beaded longitudinal edges. The membranes are stretched between adjacent of the arc frame members. The longitudinal edges are within the rope chases. Spreaders extend between adjacent of the arc frame members for urging apart the arc frame members from each other and for maintaining the membranes in a stretched condition.

37 Claims, 11 Drawing Sheets

U.S. PATENT DOCUMENTS

| | | | | | |
|---|---|---|---|---|---|
| 4,841,688 | A | * | 6/1989 | Rinaldi | 52/63 |
| 4,885,877 | A | * | 12/1989 | Hunt et al. | 52/63 |
| 4,896,992 | A | * | 1/1990 | Muhlethaler | 403/297 |
| 5,181,352 | A | * | 1/1993 | Friedman | 52/58 |
| 5,269,106 | A | | 12/1993 | Stafford et al. | |
| 5,333,425 | A | | 8/1994 | Nickerson et al. | |
| 5,596,843 | A | * | 1/1997 | Watson | 52/71 |
| 6,318,047 | B1 | * | 11/2001 | Richardson | 52/734.2 |

FOREIGN PATENT DOCUMENTS

| | | |
|---|---|---|
| CA | 1059871 | 8/1979 |
| CA | 1059872 | 8/1979 |

OTHER PUBLICATIONS

Universal Fabric Structures, Drawing—"Profile 380/165/6-6.5", Jul. 19, 1994.

* cited by examiner

STRESSED MEMBRANE STRUCTURE

FIELD OF THE INVENTION

The present invention relates to structures and, in particular, to pre-fabricated, modular, relocatable stressed membrane structures that are readily assembled from a kit or set of components.

BACKGROUND OF THE INVENTION

A common type of demountable building is one having a plurality of arc frames disposed in vertical planes extending traversely of the building and spaced apart longitudinally of the building, each arc frame being mounted on the ground or on a ground support so as to be movable during assembly longitudinally of the building by adjustable spreader devices acting between pairs of neighboring arc frames. In this manner, fabric membranes held between the pairs can be tensioned.

One of the first patents issued for the above-mentioned type of building was Canadian Patent 937,479 of Sprung issued Nov. 27, 1973. The patent disclosed a building structure having a plurality of vertically erected, parallel, longitudinally spaced arc frames that rose from a wide base to a peak. The arc frames were originally made of laminated wooden beams, but subsequently they were made of aluminum I-beams. Coated nylon membrane coverings consisting of elongated strips were laid between adjacent arc frames, the opposite sides being thickened to provide a bead-like edge for clamping attachment to the outside of the arc frames on either side. After the membrane coverings were clamped to the spaced arc frames, in a relatively slack condition, the arc frames were spread to tension the respective membrane coverings by the use of a spreader. Canadian Patent No. 1,059,871 of Sprung issued Aug. 7, 1979, described and illustrated and improved constructions of such a building structure.

U.S. Pat. No. 4,229,914 of Lucas issued Oct. 28, 1980 discloses a building structure including a plurality of arc frames in vertical planes. Each of the arc frames has a plurality of mutually inclined straight parts of generally I-beam cross-section. The arc frames are retained in their fixed position by horizontal bracing struts consisting of square cross-section tubes. Beading of the elongate strips for the building permits attachment to the arches.

U.S. Pat. No. 5,181,352 of Friedman issued Jan. 26, 1993 discloses a rain cap system for assembly junctions of a stressed membrane structure. The arches illustrated in the patent each include a plurality of hollow extruded box-beam segments. The box-beam segments are formed with pairs of longitudinally extending, outwardly opening, rope chases on opposite sides thereof. An aluminum rain cap is conformed to cover the junction of box-beam segments. The cap is held in place by the spring tension of the metal cap, which allows it to grip the box-beam segment by means of two lips.

Previously rope chases for the beams used in the arc frames were welded or bolted onto the beam. The arc frame spacing associated with these types of beams was small, for example, only slightly more than 5 feet on center.

A known method of insulating such demountable structures includes the installation of foil back bubble wrap with 1" thick ducting insulation. This provides poor insulation.

The preferred known method for installing the membrane cover for such demountable structures involves inserting the membranes downwardly from the peak of the structure. Problems associated with this method include the need for lifts to move assembly workers to the peak, increased assembly time, and increased danger to the assembly workers.

SUMMARY OF THE INVENTION

According to one example of the invention, a building structure is provided including a plurality of arc frame members spaced along a length of the building structure. Each of the arc frame members extends from a first foot portion to a peak, and back to a second foot portion. Each of the arc frame members includes a plurality of beams. Each of the beams includes a central web extending between two opposed flanges. Each of the flanges has two bifurcated ends. The ends define c-shaped rope chases with openings. The building structure further includes elongate membranes having beaded longitudinal edges. Each membrane is stretched between adjacent arc frame members. The longitudinal edges of the membranes are adapted to lie within the rope chases. The building structure further includes bases having a ground-engaging surface. The bases are adapted to be slidably mated with the first and second foot portions so as to be movable between an installation position and an operation position. In the installation position, the bases are connected to but extend away from the first and second foot portions creating a gap between the ground engaging surface and the first and second foot portions. The gap facilitates introduction of a leading edge of one of the beaded longitudinal edges of each membrane into the rope chases at the first foot portion, around the peak and back to the second foot portion. In the operation position, the bases are moved proximate to the first and second foot portions so as to substantially remove the gap between the ground engaging surface and the first and second foot portions after introduction of the longitudinal edges of the membranes into the rope chases. A plurality of spreaders extend between adjacent ones of the arc frame members for urging apart the arc frame members from each other and for maintaining the membranes in a stretched condition. The rope chase openings of at least one of the two opposed flanges are substantially angled out of the line of their flange toward the interior of the building structure in a manner so as to permit drawing the members through the rope chases with reduced friction during erection of the structure.

According to another embodiment of the invention, a beam intended for a building structure is provided. The building structure includes a plurality of arc frame members and elongate membranes. The arc frame members are spaced along a length of the building structure. Each of the arc frame members includes a plurality of beams which include the beam. Each of the membranes is secured by its opposite longitudinal edges between an adjacent pair of the frame members in a region between the interior and exterior of the building structure. The beam includes a central web extending between opposed first and second flanges, each flange having two bifurcated ends, the ends defining c-shaped rope chases with openings, and means for attaching a spreader to the central web. The spreader extends from a beam of an adjacent arc frame member for urging apart the arc frame member containing the beam from the adjacent arc frame member and maintains the membranes in a stretched condition. The chases are adapted for receiving the longitudinal edges of the membranes. The rope chase openings of the first and second flanges are substantially angled out of the line of each flange toward the interior of the building structure in a manner so as to permit drawing the membranes through the rope chases with reduced friction during erection of the structure.

According to another example of the invention, a telescoping spreader for moving apart spaced, adjacent arc frame members of a building structure is provided. The spreader includes a substantially hollow bar defining a longitudinal axis of the spreader. A connector has first and second webs in substantially mutually perpendicular relation. The first web is adapted to be attached in parallel relation with a central web of an adjacent arc member. An extension bar has a web adapted to be attached in parallel relation to the second web of the connector. The extension bar extends along the longitudinal axis while attached to the connector. The web of the extension bar is separate from and intermediate the opposed flanges of the adjacent arc frame member. The hollow bar surrounds the extension bar and has interior ridges defining two opposed grooves within the hollow bar to accept the web of the extension bar in a sliding fit along a plane that substantially longitudinally bisects the hollow bar. A locking assembly fixes the position of the extension bar relative to the hollow bar.

According to another embodiment of the invention, a building structure is provided including a plurality of arc frame members spaced along the length of the building structure. Each of the arc frame members extends from a first foot portion to a peak, and back to a second foot portion. Each of the arc frame members includes a plurality of beams. Each of the beams includes a central web extending between two opposed flanges. Each of the flanges has two bifurcated ends. The ends define c-shaped rope chases with openings. The building structure further includes bases adapted to be slidably mated with the first and second foot portions, and elongate membranes having beaded longitudinal edges. The membranes are stretched between adjacent ones of the arc frame members. The longitudinal edges are adapted to lie within the rope chases. A plurality of spreaders each extend between adjacent ones of the arc frame members for urging apart the arc frame members from each other and for maintaining the membranes in a stretched condition. Each of the spreaders includes a substantially hollow bar defining a longitudinal axis of the spreader, a connector, an extension bar, and a locking assembly. The connector includes first and second webs in substantially mutually perpendicular relation. The first web is adapted to be attached in parallel relation with the central web of an adjacent arc member. The extension bar has a web adapted to be attached in parallel relation to the second web of the connector. The extension bar extends along the longitudinal axis while attached to the connector. The web of the extension bar is separate from and intermediate the opposed flanges of the adjacent arc frame member. The hollow bar surrounds the extension bar and has interior ridges defining two opposed groves within the hollow bar to accept the web of the extension bar in a sliding fit along a plane that substantially longitudinally bisects the hollow bar. The locking assembly fixes the position of the extension bar relative to the hollow bar.

BRIEF DESCRIPTION OF THE DRAWINGS

These and other advantages of the invention will become apparent upon reading the following detailed description and upon referring to the drawings in which:—

Figure 1:
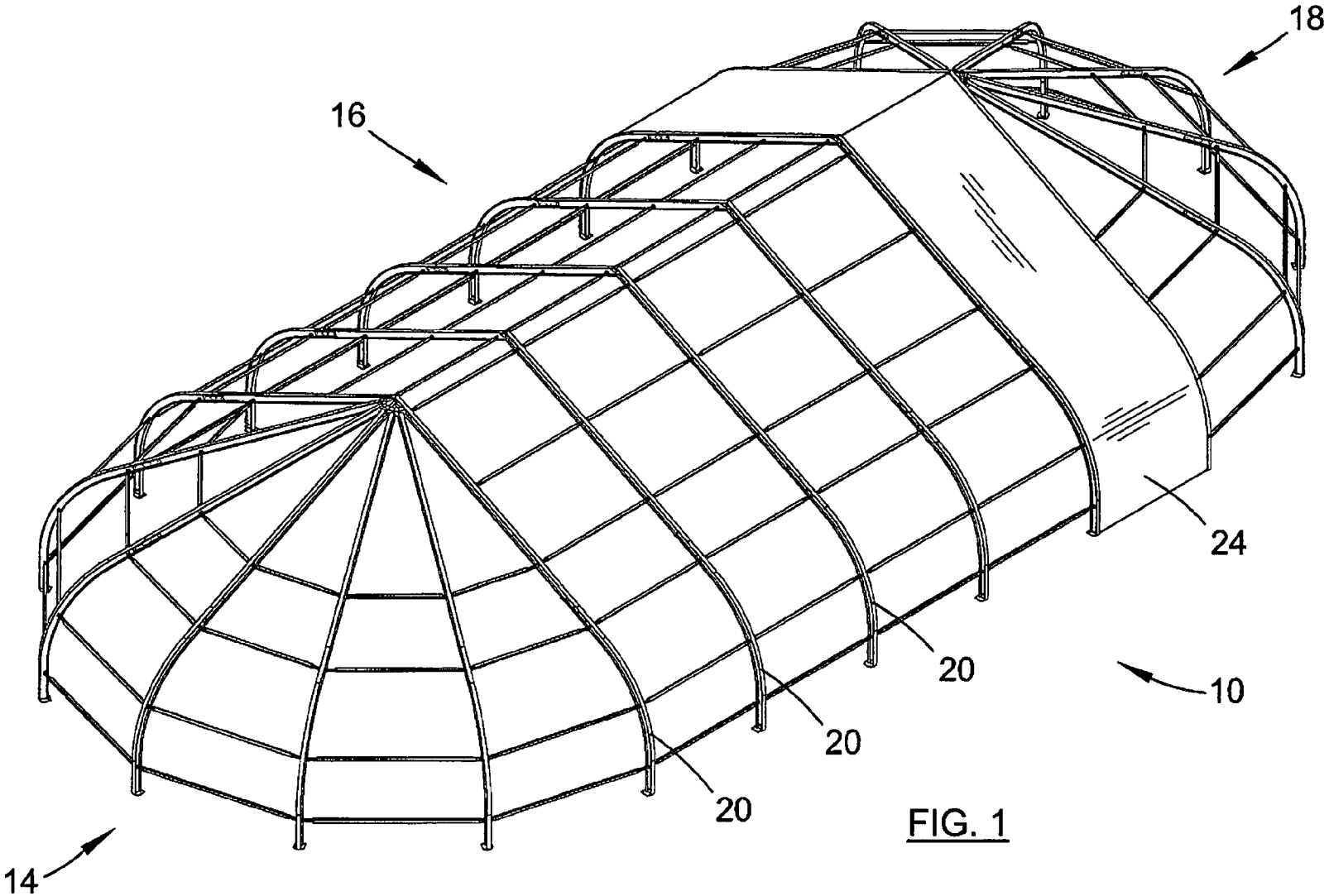
FIG. 1 is a cut-away perspective view of a demountable building structure according to an embodiment of the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings may have been given the same reference numeral or similar reference numerals.

Figure 2:
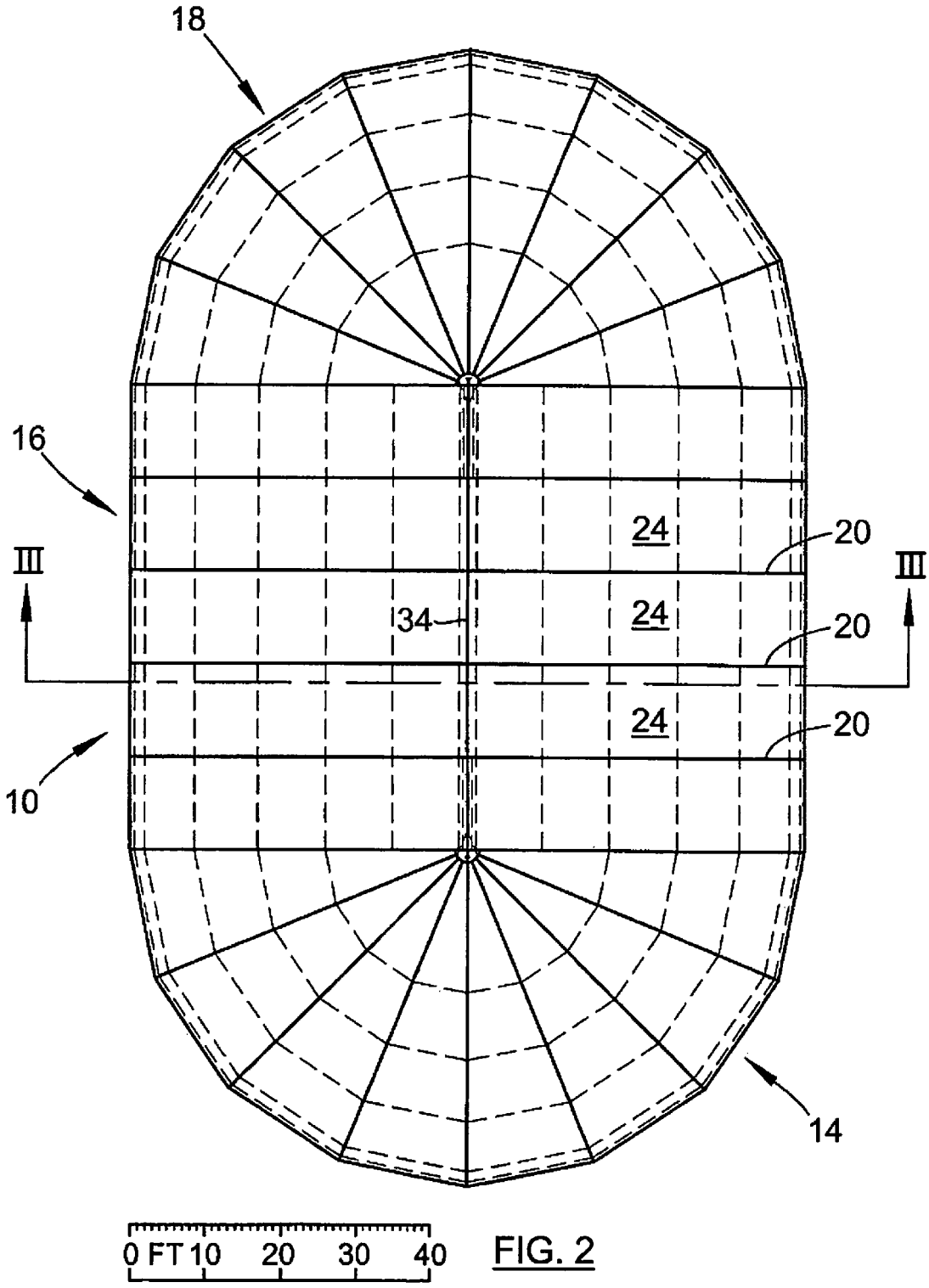
FIG. 2 is a plan view of the building structure of FIG. 1.

A demountable building structure 10, of generally round-end configuration is illustrated. It will be understood that the building structures according to the present invention however can have different configurations, for example the ends may be squared. As can be seen in FIG. 2, demountable building structure 10 is divided into three sections: a first end section 14, a central section 16, and a second end section 18. The central section 16 includes a plurality of longitudinally spaced arc frame members or arc frames 20 and elongate strips or membranes 24 which are made of a flexible, impermeable material, and provide enclosure for the structure 10.

The membranes 24, alternatively referred to as fabric membranes, are of the type having beaded parallel longitudinal edges. The membranes 24 are secured by their enlarged longitudinal edges, each between an adjacent pair of the arc frames 20, in a region between the interior and exterior of the building structure 10.

Figure 3:
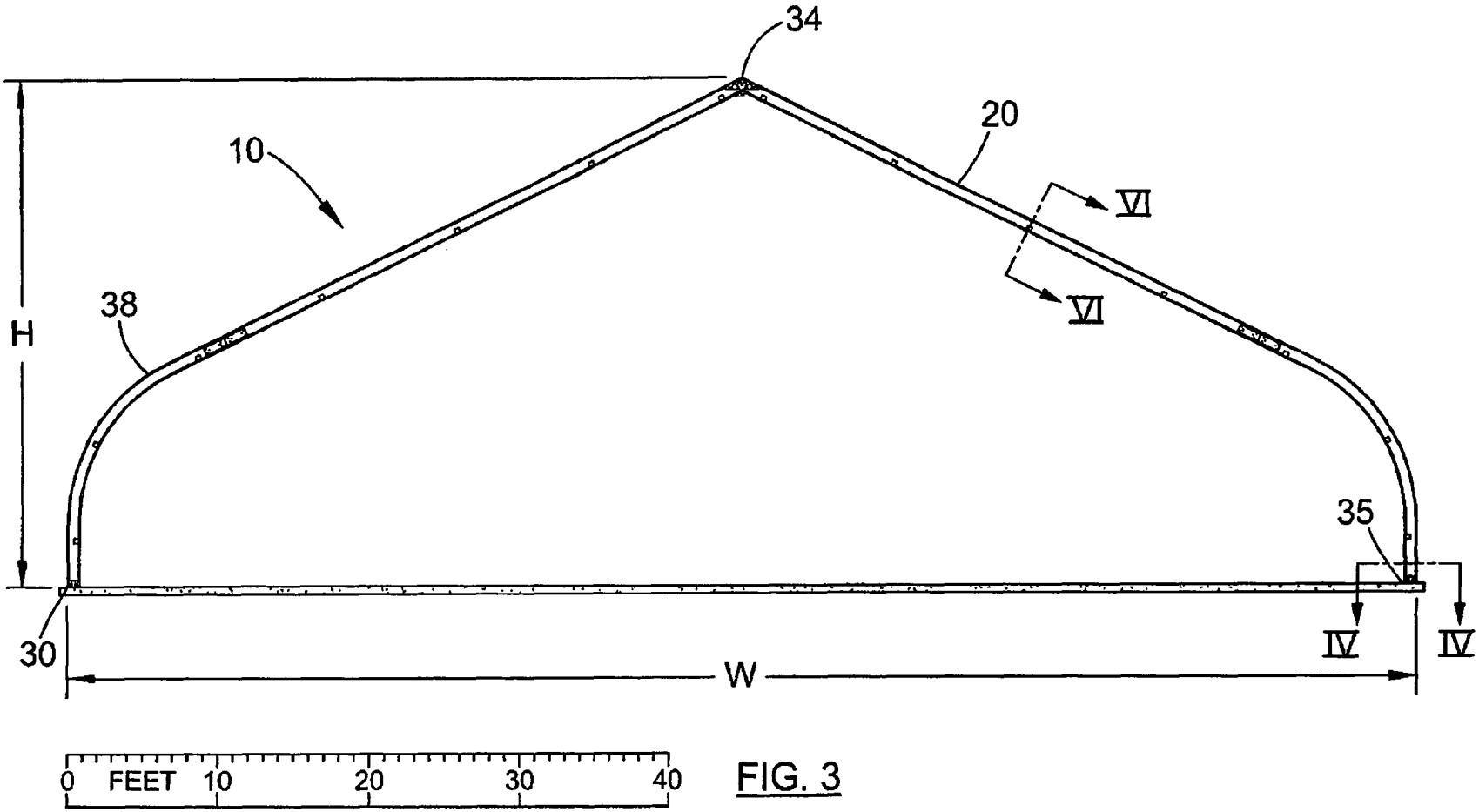
FIG. 3 is a sectional elevation view of the building structure taken along line III-III of FIG. 2.

Referring to FIG. 3, the arc frame 20 has a span W of 90' in the illustrated embodiment. Consequently, the structure 10 is referred to as a 90' structure. Height H of the illustrated arc frame 20 is approximately 35.4°. The illustrated structure is suitable for spans of 30' to 90', but essentially the same structure can be provided with larger spans if larger (stronger) arc frame members are used.

Some structure components suitable for the 90' structure are not suitable for structures having arc frame spans in excess of 100'; however a variety of other span widths are possible besides 90'. Other possible span widths for example are 30', 40', 50', 60', 70' and 80' among other custom widths.

Figure 4:
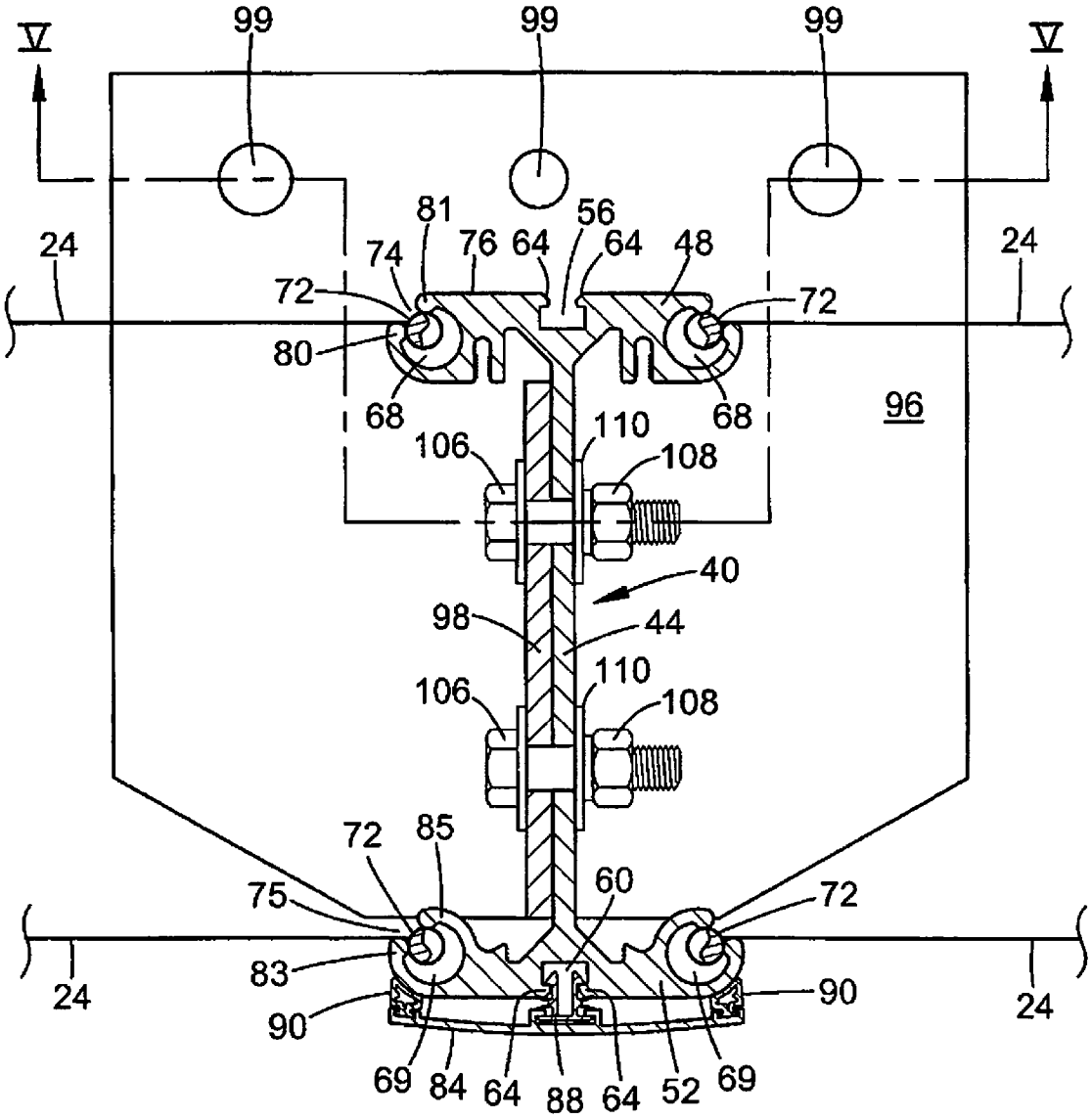
FIG. 4 is an enlarged sectional view taken along line IV-IV of FIG. 3 and illustrating an arc frame attached to a beam base plate.

Each of the arc frames 20 extend from a first foot portion 30 to a peak 34, and back to a second foot portion 35. Each of the arc frames 20 includes a plurality of beams, some curved, and others substantially straight. The beam illustrated in cross-section in FIG. 4 is an I-beam, and so too are the other beams of the arc frame 20. I-beams are structurally advantageous for constructing the structure 10.

The elevational profile of the arc frame 20 is shown in FIG. 3. The arc frame 20 extends upwardly from both base contact ends of the foot portions 34, 35 approximately 4' as measured along the beam's outer edge before curving inwardly toward the peak 34. The curved portions of the arc frame 20 are approximately 13.4' in length as measured along the outer edge. The roof portion of the arc frame 20 has an inverted V shape. Beams of the roof portion are upwardly inclined at an angle of approximately 26°. A portion of the arc frame 20 as measured from the peak 34 to curve transition point 38 is approximately 42.6' in length. This configuration of roof portion provides a slope which facilitates gravity removal of rain and snow which might otherwise accumulate on this roof portion.

Other embodiments of the arc frame will have different dimensions than the above mentioned dimensions for the arc frame 20. In the case of a 40' structure, one possible arc frame for this structure will have a span of 40' and a height of approximately 21.3'. This particular arc frame would extend upwardly from both base contact ends of the foot portions of the arc frame approximately 4' as measured along the beam's outer edge before curving inwardly towards the peak of the arc frame. The curved portions of this arc frame would be approximately 13.4' in length as measured along the outer edge. Beams of the roof portion would be upwardly inclined at an angle of approximately 26°. The portion of this arc frame from the peak to the curve transition point 38 would be approximately 14.8' in length. One skilled in the art will recognize that with varying span sizes the length of the curved portions, the upward incline, and peak to transition point lengths will vary accordingly to meet design criteria.

I-beam 40 illustrated in FIG. 4 has a central web 44 with an outer or first flange 52 at one end of the web 44, and an inner or second flange 48 at the other end of the web 44. The flanges 48 and 52 are at opposed ends of the I-beam 40 and are integral with the web. The web 44 is parallel to a vertical plane when the arc frame is erected.

The flanges 48 and 52 are both thicker than the web 44, and have a central channel 56 and 60 respectively. Channels 56, 60 have an opening which is reduced in width by inwardly intruding ribs 64. The channels 56, 60 permit a ⅜" square-headed bolt to be slid in. Thus a structure (such as a sign) can be bolted into the flange 52. Similarly a structure can be attached to the other flange.

In one embodiment, the I-beam is a 5" by 10" extruded aluminum I-beam; however it will be appreciated that other cross-sectional dimensions for the I-beam are possible. 8"×12" I-beams may be particularly desirable for structures having arc frame spans from 100' to 160'. Also aluminum is not the only suitable material for the production of the I-beam.

Both the flanges 48 and 52 have bifurcated ends. Each of the bifurcated ends of the flange 48 comprise edges 80 and 81. Each of the bifurcated ends of the flange 52 comprise edges 83 and 85.

Each of the bifurcated ends of the flange 48 define a c-shaped rope chase 68. Each of the bifurcated ends of the flange 52 define a c-shape rope chase 69. Rope chase openings 74, 75 are associated with the rope chases 68, 69 respectively. The openings 74 and 75 are sufficiently constricted so as to prevent egress of the beaded edges 72 from the rope chases.

Functional benefits come from the shape of the chases disclosed in this application. Rope chases found in various prior art demountable building structures contribute to water sealing deficiency at the rope chase-membrane interface. The double-edge portions of an embodiment of the invention facilitate reduced friction with respect to movement of the beaded edges through the rope chases of the arc frames.

As in the prior art, the walls of the rope chases 68 are shaped to accommodate beaded edges 72 of the membranes 24. Each of the rope chases 68, 69 is accessible via an opening 74, 75 respectively. The openings 74, 75, are each sufficiently restricted so as to prevent the beaded edge 72 of the membrane 24 from becoming dislocated from the rope chase 68.

Because of the shape of the flange edges, the openings 74, 75 are oriented towards inner side 76 of the I-beam when in constructed orientation. Also, the openings 74, 75 are substantially angled out of the line of their flanges 48, 52 respectively in a manner so as to permit drawing the membranes 24 through the rope chases with reduced friction (i.e. the openings are sitting in the natural direction of a loose hanging membrane, so that the membrane will drop in a natural direction when it is being drawn along the frame members 20) during the subsequently discussed method for advancing an elongate membrane between a pair of side by side arc frame members. In more specific terms, it is intended that the orientation of the openings 74, 75 will permit a loose hanging membrane to centrally exit its associated rope chase openings, and thereby reduce friction between the membrane 24 and the adjacent arc frame members 20 during membrane advancement as compared to, for example, where the design is such that the rope chase openings are not out of the line of their flanges. As well, once the membrane is in position and adjacent frame members 20 are urged apart to stretch the membrane 24, the water seal between the membrane and its associate frame members is improved by the orientation of openings 74 and 75.

The flange edges 80 and 83 extend outwardly from the web 44, and curve towards the interior of the structure 10 through an angle in excess of ninety degrees. Also, the flange edges 80 and 81 that define the opening 74 are rounded and relatively enlarged at the opening 74. So too the edges 83 and 85 that define the opening 75 are rounded and relatively enlarged at the opening 75.

This construction of arc frame members 20 permits building structure 10 to have either a single, exterior membrane cover, or a dual membrane cover of both exterior and interior membrane layers.

A thermal cap 84 is attached over an outer side of the I-beam by means of a plurality of resilient clips (including clip 88) which snap into the channel 60. The thermal cap 84 can be made of the same metal as the adjacent I-beam, and can be coloured by powder coating to match the membranes 24. In the illustrated embodiment, the thermal cap 84 is slightly curved, and has seals 90 extending along both of its ends. In the illustrated embodiment, the thermal cap 84 avoids direct contact with the adjacent I-beam.

The thermal cap 84 is a means for reducing heat transfer between the interior and exterior of the structure 10. The thermal cap 84 prevents direct exposure of the I-beam 40 to the air outside of the structure 10. It will be appreciated that metal is an excellent heat conductor, and hence when the outside air is cold, for example, heat transfer to the outside air is reduced by the thermal cap 84, which as mentioned is not in direct contact with the adjacent I-beam 40.

The elongate seals 90, which are preferably made of neoprene, engage the outer surface of the flange 52 to reduce the possibility of water leaking from the exterior surface of membrane 24 into inside of structure 10. The illustrated seal 90 has a central internal channel extending the length of seal; however the seal could also be completely solid.

The sealing action facilitated by the seals 90 is enhanced by the orientation of the openings 75. More specifically, the orientation is particularly effective in preventing ingress of water into the rope chases 69, since exterior water would have to flow up and over edges 83 to enter the chases.

Figure 5:
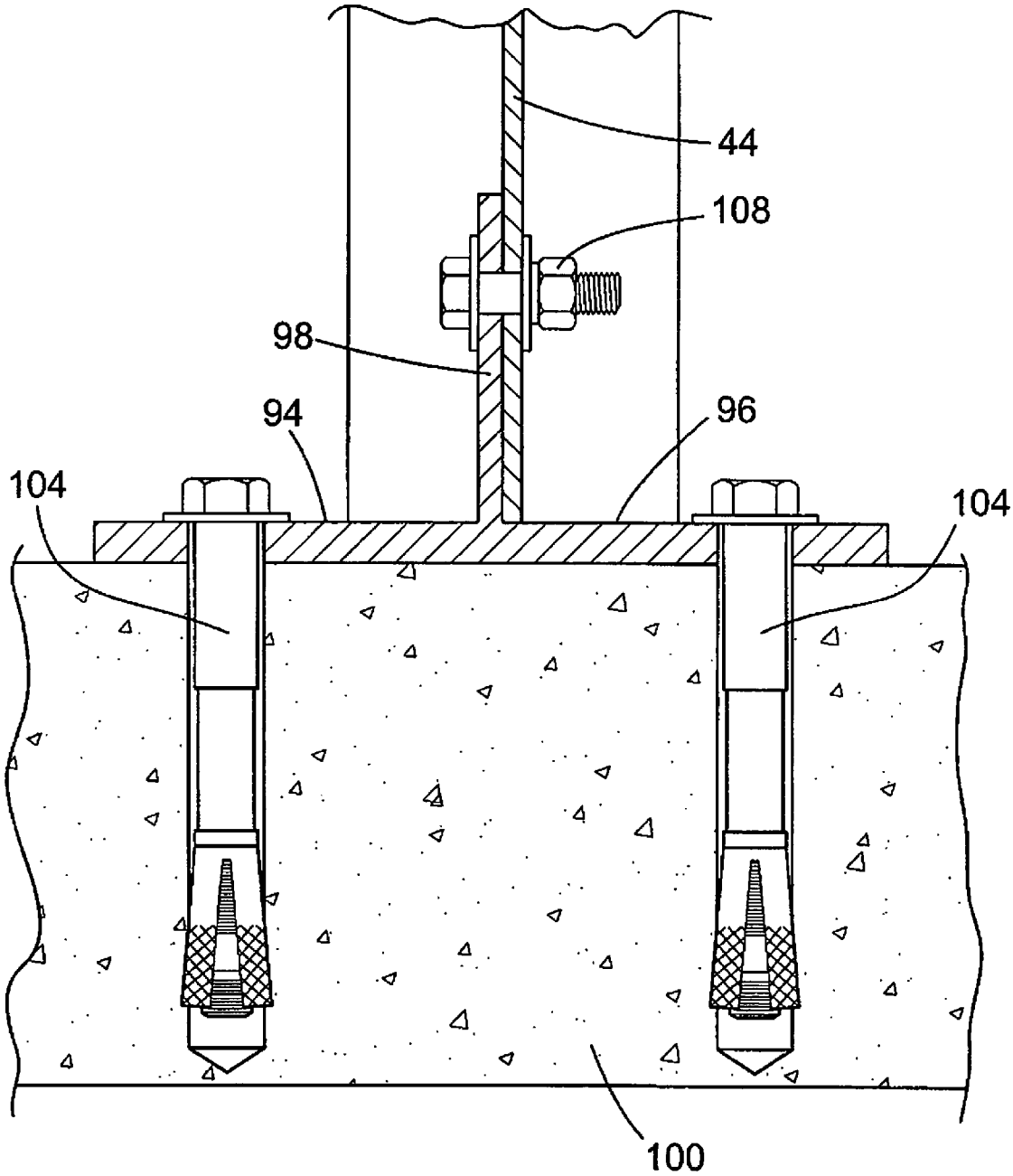
FIG. 5 is a sectional view taken along line V-V of FIG. 4 and illustrating the beam base plate anchored into a concrete slab.

An integral base plate, slideably mateable with the foot portion of an arc frame, is illustrated in FIGS. 4 and 5. This component includes a base plate 94 that has a flat base member 96 and an upwardly extending web 98 formed integrally therewith. The base plate 94 can be made of aluminum or any suitable material. In the illustrated embodiment, the base member 96 is a 1' by 1' square with two corners absent, with the base member 96 being ⅝" thick, and the web 98 being ⅜" thick. It will be understood that the base member 96 can have different dimensions than the above recited dimensions. More particularly, with larger versions of the structure, a larger integral base plate is required.

Apertures 99 are provided in the base member 96 to permit attachment of the base plate 94 to a concrete slab or foundation 100 by means of anchor bolts 104 which are implanted into the slab 100. At least two anchor bolts are used per column base. Apertures are provided in both the web 98 and the adjacent I-beam for rigidly attaching the I-beam to the base plate 94 by suitable connector assemblies, which in the illustrated embodiment include ⅝" by 2" bolts 106, nuts 108 and washers 110; however alternative connector assemblies can have differently sized mating components, or comprise a different set of mating components.

It may be that concrete slabs or foundations 100 are not available, in which case a foot portion of arc frame members 20 may alternatively have pins and/or earth anchors to be used in conjunction with the integral base plates, for securing to the ground and supporting structure 10.

As well, one skilled in the art will appreciate that a variety of other bases besides the illustrated base are possible. For example, the base could be more similar in appearance to the two-web base illustrated in U.S. Pat. No. 4,583,331. Nevertheless, the illustrated base is favoured in the illustrated embodiment because of its ability to resist bending. Also, fewer connections are associated with the illustrated base as compared to known bases, making erection of the building structure 10 easier.

Figure 6:
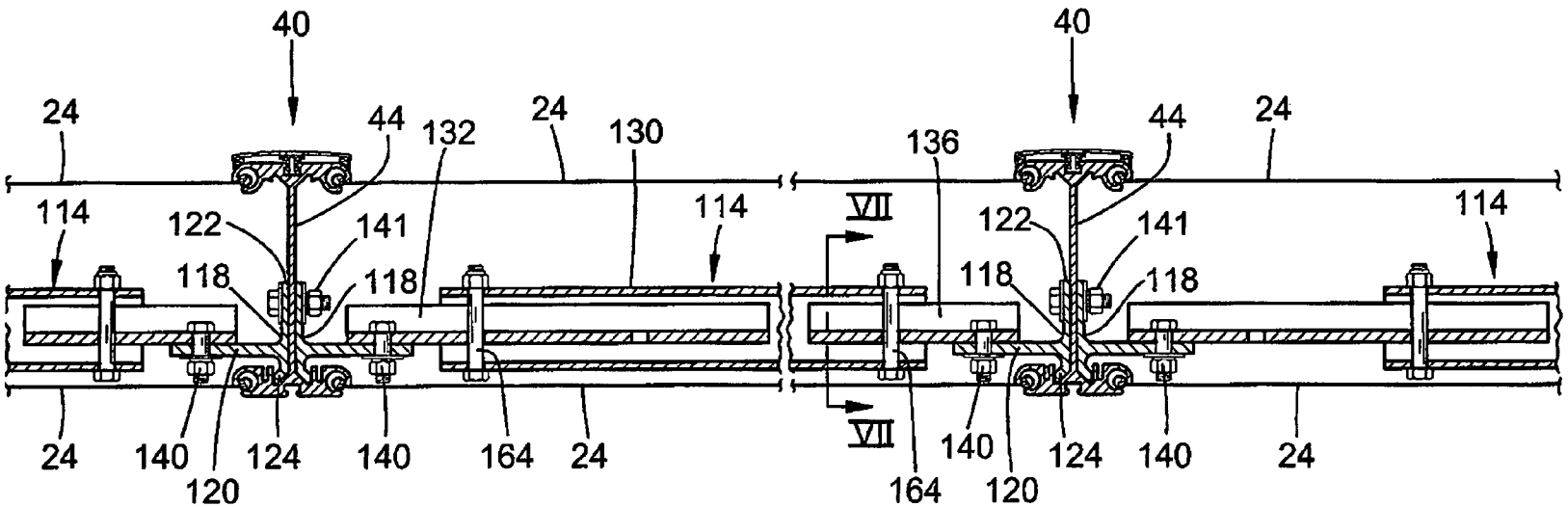
FIG. 6 is a sectional view taken along line VI-VI of FIG. 3 and illustrating spreaders between the arc frames.

FIG. 6 is a cross sectional view of a roof portion of a building structure 10 taken along line V-V shown in FIG. 3. Spreaders 114 extend between I-beams 40 of adjacent arc frames 20. The spreaders 114 urge apart the arc frames 20 from each other, and maintain the membranes 24 in a stretched condition. The spreaders 114 are attached to the I-beams 40 by means of spreader connectors 118. Each of these spreader connectors 118 include an outwardly extending member 120, a flange 122 perpendicular to the member 120, and a grapple portion 124.

The spreader 114 includes a somewhat square shaped, hollow bar 130, and pi-shaped bars (pi bars) 132 and 136. The outwardly extending ends of the pi bars 132 and 136 attach to the members 120 of the spreader connectors 118 by means of connector assemblies 140, which in the illustrated embodiment include a ⅝"×2¼" bolt, a nut and washers; however alternative connector assemblies can have differently sized mating components, or comprise a difference set of mating components. The spreader connectors 118 are in turn attached to the I-beams by means of connector assemblies 141 which extend through apertures in the flanges 122 and the web 44. The attaching means also includes channels in the interior flange 48 which are sized to receive the grapple portions 124. In prior art designs, the spreaders needed to be bolted onto the I-beams. Removing the need to bolt the spreaders onto the I-beams directly makes assembly of the building structure easier. The use of the spreader connectors 118, and the shape of the arc frame I-beams permit this.

In the illustrated embodiment, the spreader 114 is secured to the adjacent arc frame members by securing means comprising the connector assemblies 140, the spreader connectors 118, and the grapple portions 124. It will be understood by one skilled in the art that various alternative securing means can be used, such as direct bolting (described in the previous paragraph).

Figure 7:
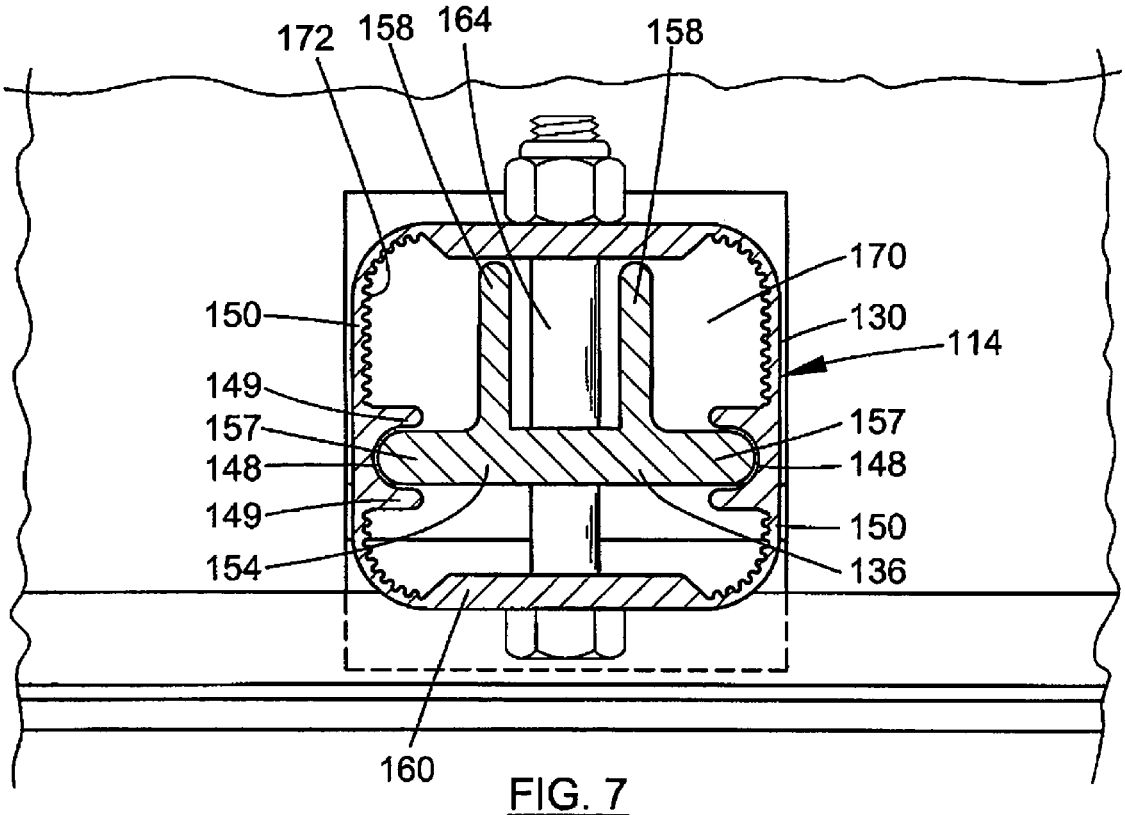
FIG. 7 is a sectional view taken along line VII-VII of FIG. 6 and illustrating further details of one of the spreaders.

FIG. 7 is a cross-section view of the spreader 114 taken along the line VI-VI shown in FIG. 6. Grooves 148 are formed in opposite walls 150 of the spreader 114. In particular, two ridges 149 define each of the grooves 148. The pi bar 136 includes a web 154 having two opposite edges 157 and two parallel ribs 158. The pi bar 136 is slidably connected to the spreader 114 via the grooves 148. Specifically, the edges 157 are slidable along the grooves 148.

The web 154 is substantially spaced apart from wall 160 of the spreader 114, and the web 154 is closely adjacent a plane longitudinally bisecting the pi bar 136. The pi bar is close to the centroid of the spreader. This positioning of the pi bar within the spreader increases the strength of the spreader.

As will be understood by those skilled in the art, the spreaders 114 are used to spread the arc frames to suitably tighten the membranes 24 between the arc frames. In particular, known hydraulic rams can be used in conjunction with the spreaders 114. In the stretching process, the pi bars 136 of the spreader 114 telescope outwardly until the membranes 24 are suitably tightened, at which point locking assemblies or locking means 164 fix the position of the pi bars 136 within the hollow bar 130. Also during the stretching process, the membrane panels of the structure are compensated by approximately ±1% to ensure that each panel is equally tensioned between the arches.

Cavity 170 within the hollow bar is defined by walls having ribbing 172. Because the walls are ribbed, the strength of the spreader 114 is increased.

The illustrated spreader includes two pi bars; however it would be possible for there to be only one pi-bar per spreader instead of two per spreader. It will be understood by one skilled in the art that various alternative securing means can be used, such as direct bolting (described in the previous paragraph). In this embodiment, the spreader connector 118, to which pi-bar 136 is attached, is locked in place using connector means including a mated track and one bolt.

Figure 8:
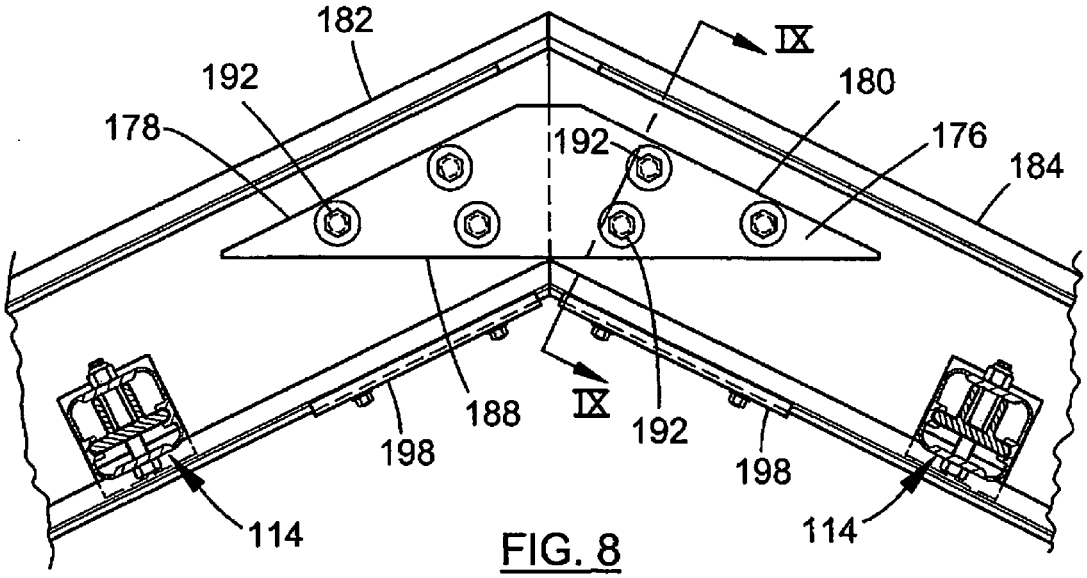
FIG. 8 is an elevational view of a peak portion of an assembled arc frame, peak rollers not being shown in this figure.
Figure 9:
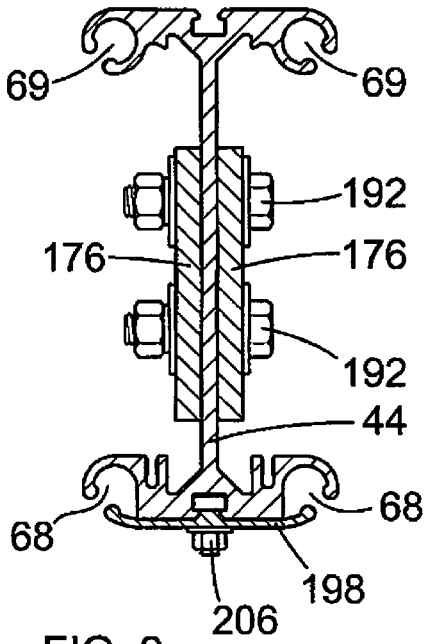
FIG. 9 is a sectional view taken along line IX-IX of FIG. 8 and illustrating a beam splice at the peak.

FIGS. 8 and 9 illustrate the peak 34 of the structure 10. Although it would be possible to construct a peak region comprising a single I-beam 40, in the illustrated embodiment the peak region comprises the ends of two I-beams 40. Therefore, two peak splice plates 176 are used to join the adjacent I-beams at the peak 34.

In the illustrated embodiment, the plate 176 is a ½" thick aluminum plate having a trapezoid shape. Edges 178 and 180 of the plate 176 are substantially parallel to top edges 182 and 184 respectively of the I-beams. In the illustrated embodiment, side 188 of the plate 176 is approximately 2'-2" in length. The plates 176 are attached to the adjacent I-beams by means of suitable connector assemblies 192, which can comprise a ⅝"×2¼" bolt, a nut and washers; however alternative connector assemblies can have differently sized mating components, or comprise a different set of mating components.

In the illustrated embodiment, inner retainer caps 198 are attached at the peak, one on both sides of the peak. It is noted that the I-beam cross-section illustrated in FIG. 9 is slightly different than the I-beam cross-section shown in FIG. 4. In particular, for each of the rope chases 68, the edge 81 has been coped. The caps 198 provide the lacking rope chase edge, and thereby prevent jamming of the membrane beaded edge at these locations. Suitable connector assemblies 206 permit attachment of the inner retainer caps 198 to the adjacent I-beam. It will be seen that the rope chases 68 have been modified at the peak so that the peak roller assembly will function properly.

Figure 10:
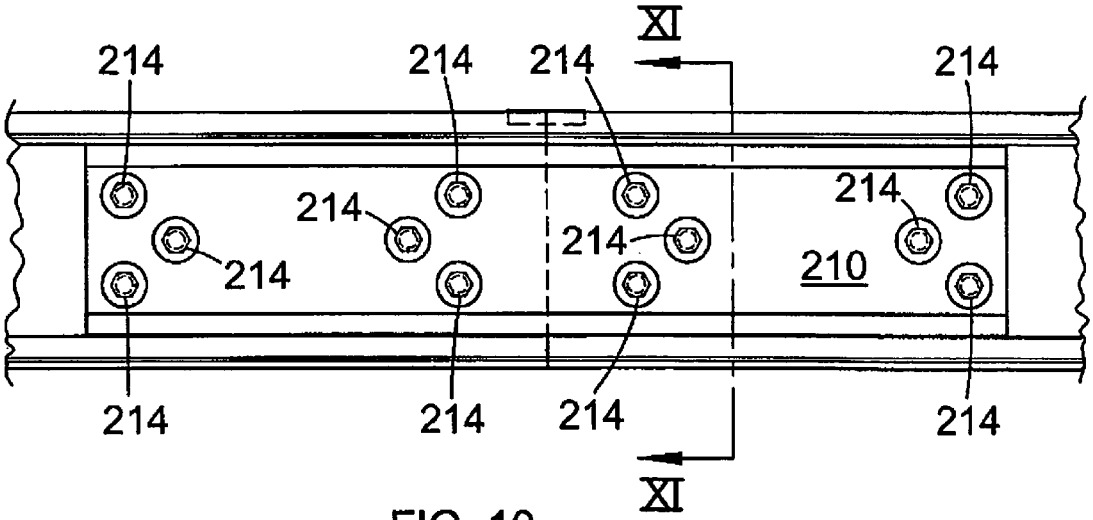
FIG. 10 is a side view of a beam splice for the arc frame.
Figure 11:
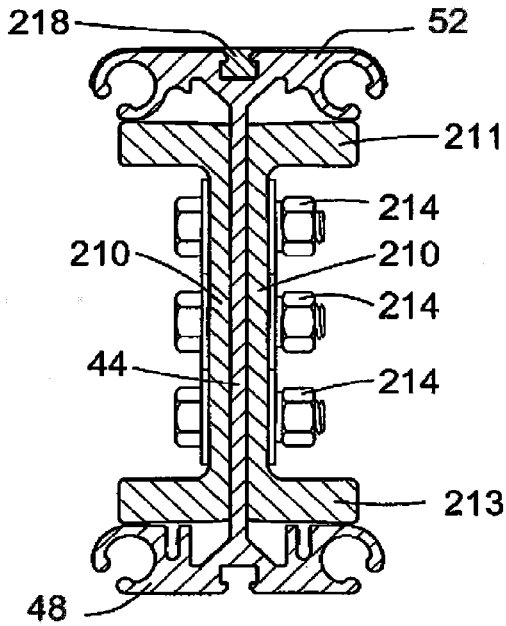
FIG. 11 is a sectional view taken along line XI-XI of FIG. 10 and illustrating further details of the beam splice.

FIGS. 10 and 11 illustrate I-beam splicing in a lower roof region of the structure 10. Two splicing plates 210 are attached to opposite sides of the I-beam web 44. In the illustrated embodiment, the splicing plates are 3'×7⅜", can be made of the same material as the I-beam 40, and have flanges 211 and 213 along their sides. These flanges extend outwardly 1⅞" from the web 44. These flanges 211 and 213 are also closely adjacent the flanges 48 and 52 respectively, providing reinforcement for the rope chases 68, 69 respectively. It will be understood that the splicing plates 210 can have different dimensions than the above recited dimensions.

Four sets of three connector assemblies 214 are used to attach the splicing plates 210 to the web 44. Connector assemblies 214 in each set are in a V-formation (as best seen in FIG. 10). The connector assemblies 214 can be the same configuration as the connector assemblies 192 shown in FIG. 9. In one embodiment of the building structure 10, substantially the same size and configuration of connector assemblies are used for most connections to reduce assembly complexity. In the illustrated embodiment, each set of connector assemblies is spaced at least 7" from an adjacent set of connector assemblies. A thin flashing 218 is attached over the outer exposed surface of the flange 52. The flashing 218 protects the central channel of the flange, and facilitates weather protection.

Figure 12:
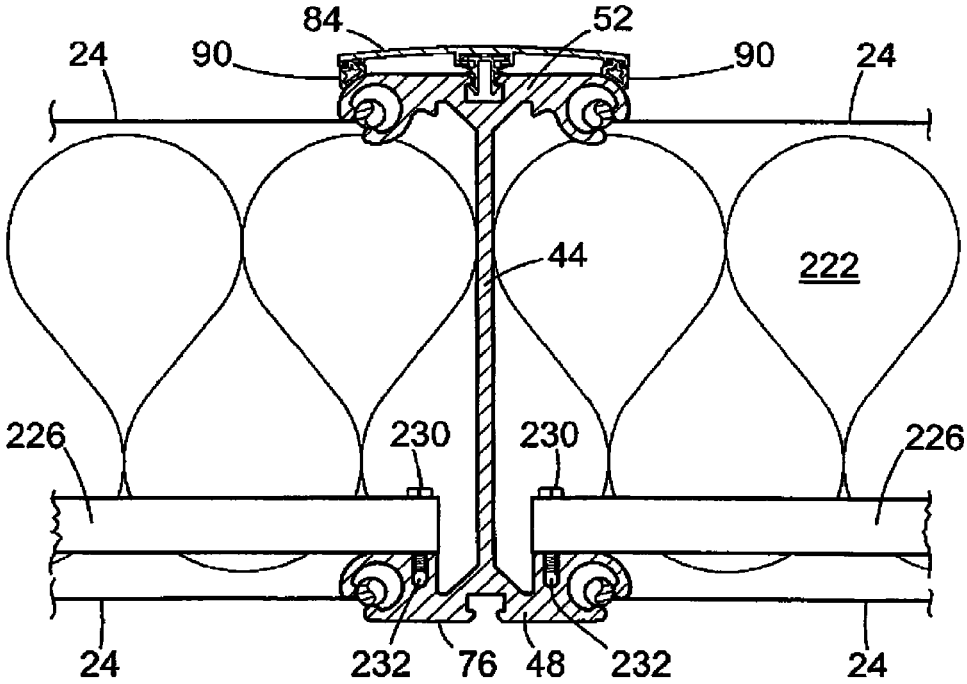
FIG. 12 is a sectional view illustrating an insulation system for the building structure.

It is possible to insulate the structure 10 to make it suitable for colder climates. A preferred insulation system is illustrated in FIG. 12. In particular, fiberglass insulation 222 is fitted in between the interior and exterior membranes 24. The insulation system also includes insulation retaining tubes 226, approximately 2' on center. The tubes 226 can be made from a variety of different materials, including aluminum. Also, the tubes 226 are in a telescoping arrangement, perpendicular to the web 44, and are spaced a pre-determined distance outwardly from the flange face 76, such spacing distance may be in the order of 1¼". Bolts 230 secure the tubes 226 to the flange 48, the bolts 230 fit into bolt receptacle channels 232 formed in the flange 48. Sections of insulation are fitted in between the pi-bars 136, and 3M™ tape strips of about 7 or 8 inches in width are stuck over the inner flange 48 to extend from one end of that arc frame to the other, the tape and insulation thereby providing a vapour barrier against humidity. As well, insulation by taping the edges of sections of insulation 222 to the corresponding arc frame members 20, assurance is provided that the insulation is stretched out completely between the adjacent frames as the frames are spread outwardly, away from each other, during the tensioning of the membranes. Otherwise the insulation might not spread and might leave gaps between the section edges and the arc frame members after they are spread.

It will be appreciated that because the space between the interior membranes and the exterior membranes can be mostly filled with insulation, the amount of dead air space between the membranes is advantageously minimized. The exterior seal around the I-beam, which includes the thermal cap 84 and the seals 90, prevents water damage to the insulation 222.

Figure 13:
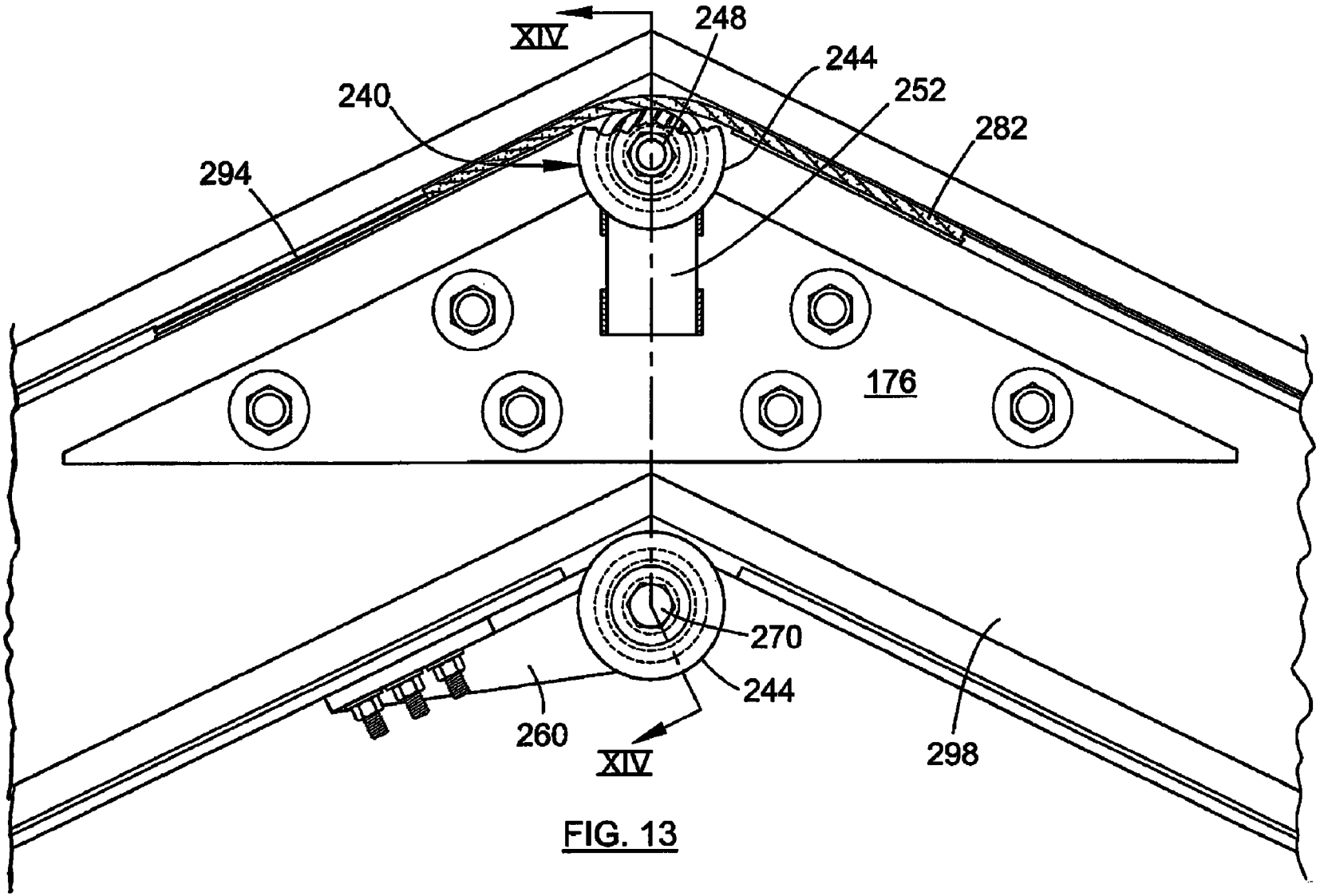
FIG. 13 is a diagrammatic illustration of a peak roller assembly attached at the peak of an arc frame.
Figure 14:
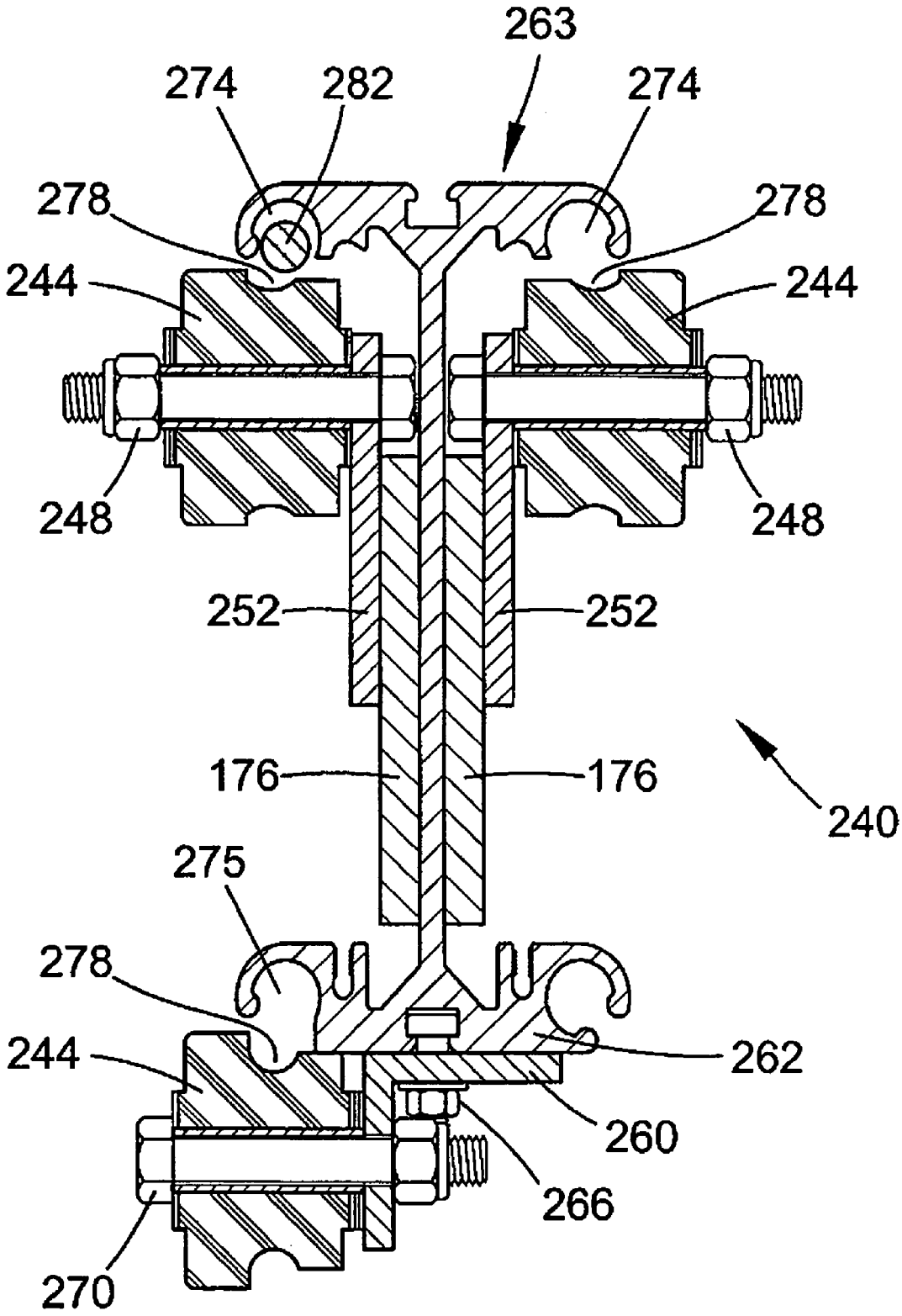
FIG. 14 is an elevational view of the peak roller assembly.

Referring to FIGS. 13 and 14, a peak roller assembly is used in a method for advancing the membranes 24 through the rope chases 68, 69 of the arc frames 20 when the building structure 10 is erected or demounted. Peak roller assembly 240 includes three phenolic wheels 244. In one embodiment, the wheels 244 are 3¼"×2" in size. A wheel bearing is operatively associated with each of the wheels 244. A connector assembly 248 extends through one of the two top adjacent wheels 244 attaching the wheel 244 to a splice plate 252. The splice plates 252 are attached to the splice plates 176 by suitable attachment means (e.g. by welding). In the illustrated embodiment, the connector assembly 248 includes a ⅝"×4" bolt, a ⅝"×¾"×2⁷⁄₁₆" spanner bushing, a ⅝" lock nut and washers; however alternative connector assemblies can have differently sized mating components, or comprise a different set of mating components.

As shown in FIG. 14, a right-angled metal bracket 260 is attached to inner facing flange 262 of I-beam 263 by a suitable connector assembly 266. In the illustrated embodiment, the connector assembly 266 includes a ⅜"×1½" square head bolt and a washer, but various other types of connector assemblies or connection means are possible. A connector assembly 270 attaches one of the wheels 244 to the bracket 260. The connector assembly 270 can be the same connector assembly as the connector assembly 248; however it is noted that the connector assembly 270 is inserted through the wheel 244 in the opposite direction than the connector assembly 248 is inserted through the wheel 244.

A part of the wall, forming part of what would be the boundary for rope chase 274, has been removed to accommodate the wheel 244 (likewise for rope chase 275). A channel 278 formed around the circumference of the wheel 244 completes the rope chase 274 (likewise as well for the rope chase 275). It will be appreciated that both the channel 278 and the flange portion guide rope 282 as it advances through the rope chase 274, and thus the channel 278 of the wheel 244 needs to be sufficiently close to the rope chase forming portion of the adjacent flange in order that the rope 282 will be prevented from becoming dislodged from the rope chase 274. The same qualification applies when a rope is pulled through the rope chase 275.

It will be appreciated that the roller assemblies 240 and the single roller wheels are "permanent" in the sense that they need not (and preferably are not) removed from the peak after erection of the building structure 10.

A method for erecting the building structure 10 includes the following steps. First, the arc frame members 20 are stood up and spaced apart, and each of the foot portions 30 and 35 of the arc frame members 20 are attached to one of the bases, freely shiftable along the surface beneath the bases. The spreaders 114 are attached to the arc frame members 20, so that there are spreaders extending between each pair of adjacent frame members 20. Temporary roller assemblies are installed at the foot portions 30 and 35 (these temporary roller assemblies and the peak roller assembly 240 promote advancement of the membrane 24). Next, as described subsequently, the membranes 24 are attached to the arc frames 20. Next, as understood by one skilled in the art, the membranes 24 are down stretched with winches, and to keep them in place before the next step, bolts are put through the beaded edges. Next, each of the frame members pairs are spread by using the spreaders 114, so that spacing of the arc frame members 20 is increased and the membranes 24 are tautened. After that, the bases are secured to the slabs 100 (as exemplarily illustrated in FIG. 5) to positionally fix the arc frame members 20.

A first step in the method for connecting the membranes to the arc frames is lubricating the rope chases of the I-beams in order to reduce friction for advancement of the beaded edge of the membrane through the rope chase. Preferably, a dry silicone lubricant can be used, and this lubricant is sold in spray canisters. Conveniently therefore, the lubricant can be sprayed into the rope chases. Alternatively, the membrane chase can also be pre-lubricated.

In a preferred embodiment of the assembly method disclosed in this invention, known rope advancing machines, electric or hand-operated, are installed at an end of an arc frame pair opposite the end into which the membrane will be fed. For the 30' span version of the stressed membrane structure, it is possible to advance the ropes 282 simply by pulling on them.

Referring to FIG. 13, the rope 282 is integral or spliced to one end of a beaded edge 294 of the membrane. It will be understood that the rope 282 needs to extend from one end of arc frame 298, up over the roller assembly 240, and down to the opposite end of the arc frame 298. Consequently, the rope 282 should be about twice as long as the overthrow.

Before the advancing machines run the membrane through the rope chases by advancing two ropes 282, the lengths of the ropes 282 are positioned in the rope chases, and the lengths of rope over the roller assemblies 240. This can be done in an automated manner.

The membranes 24 are advanced from one of the arc frame member foot portions, up through the rope chases, over the peak roller assemblies 240, and down to the other of the arc frame member foot portions with the associated fabric extending outwardly from the openings for the rope chases. As the membrane is advanced into an arc frame pair, two workers stand at the base of the arc frame pair where the membrane enters into the arc frame rope chases. The workers stand at opposite edges of the membrane to ensure that the membrane properly advances into the rope chases.

A worker is also located at each of two rope advancing machines (one rope advancing machine per arc frame of the arc frame pair). These workers can control the operation of the rope advancing machines. For example, they can slow down the advancement of the membrane if instructed to do so by one of the workers at the opposite base of the arc frame pair.

The rope advancing machines are employed again when the building structure is demounted. In particular, the rope advancing machines advance the membrane half way out. At this point, the remaining portion of the membrane can simply be pulled out manually.

In addition to the roller assemblies 240 at the peaks of the arc frames 20, roller assemblies are also used at the bases of the arc frames 20 when the membranes 24 are advanced into, and pulled out of the rope chases. These base roller assemblies are "temporary" in the sense that they are taken away after they are no longer needed.

To summarize the above described method for connecting the membranes 24 to the arc frames 20, the method permits installation of the membranes by ingressive insertion from the bottom of the structure 10. This is contrasted to the traditional method for installing the membrane cover for such demountable structures, which involves inserting the membranes downwardly from the peak of the structure. Problems associated with this previous method include the need for lifts, increased assembly time, and increased danger to the assembly workers. Ingressive insertion from the bottom of the structure overcomes the problems associated with ingressive insertion at the peak.

Referring to FIG. 2, the end sections 14 and 18 of the structure 10 will not been described in detail, as to do so would be unnecessarily redundant for the purposes of the specification of this patent application, given that the construction of the central section 16 of the structure 10 has been described in detail. The end sections can be constructed using sector shaped membranes, spreaders like those that have been described, and I-beams having the same cross-section as the I-beams illustrated in FIGS. 4 and 11. Certain connectors (angled spreader connectors can be used around corners), splicing, plates, braces, cables, etc. for the end section will vary depending on the design of the end section. The end sections 14 and 18 can come with optional sliding cargo doors or other access means.

End panels of the end sections 14 and 18 can be fed from the ground and up through the peak and back of the ground using a similar system as for the central membranes. An end membrane panel is positioned under the peak radius point on the ground. The extended ropes of the panel are fed through a rounded removable track which is located at the cone or hemispherical end at the peak of the structure. This rounded removable track transitions into the rope chase of the beam. The rope is then fed down the rope chase to either a manual or electric operated winches at which time the panel is installed into the end section.

Ventilators can be installed in the roof portion of the structure 10. In one embodiment, the ventilators are attached at the peak of the roof portion.

The arc frames 20 allow for at least fifteen feet or more, depending on circumstances, on center spacing in most instances. The arc frame spacing associated with certain known arc frames is small, for example, only slightly more than 5' on center.

Thus, it is apparent that there has been provided in accordance with the invention a building structure that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A building structure comprising:

a plurality of arc frame members spaced along a length of the building structure, each of said arc frame members extending from a first foot portion to a peak, and back to a second foot portion, each of said arc frame members comprising a plurality of beams, each of said beams comprising a central web extending between two opposed flanges, each of said flanges having two bifurcated ends, said ends defining c-shaped rope chases with openings;

elongate membranes having beaded longitudinal edges, said membranes stretched between adjacent ones of said arc frame members, said longitudinal edges adapted to lie within said rope chases;

bases having a ground-engaging surface and adapted to be slidably mated with said first and second foot portions so as to be movable between: an installation position in which the bases are connected to but extend away from said first and second foot portions creating a gap between the ground-engaging surface and the first and second foot portions to facilitate introduction of a leading edge of one of the beaded longitudinal edges of said membranes into the rope chase at the first foot portion, around the peak and back to the second foot portion; and an operation position in which the bases are moved proximate to the first and second foot portions so as to substantially remove the gap between the ground-engaging surface and the first and second foot portions after introduction of the longitudinal edges of the membranes into the rope chases; and a plurality of spreaders each adapted to extend between adjacent ones of said arc frame members for urging apart said arc frame members from each other and for maintaining said membranes in a stretched condition;

wherein the rope chase openings of at least one of the two opposed flanges are substantially angled out of the line of their flange toward an interior space of the building structure in a manner so as to permit drawing said membranes through said rope chases with reduced friction during structure erection.

2. A building structure according to claim 1, wherein said beams are I-beams, and said openings are sufficiently constricted so as to prevent egress of said longitudinal edges from said rope chases.

3. A building structure according to claim 2, wherein said membranes comprise interior and exterior membranes, each of said exterior membranes lie adjacent to and above one of said interior membranes, and spaces are defined between the adjacent membranes.

4. A building structure according to claim 3 further comprising fiberglass insulation within said spaces and means for retaining said insulation.

5. A building structure according to claim 4, wherein said insulation retaining means is insulation retaining tubes attached to said beams.

6. A building structure according to claim 2, wherein said chases are coated with a dry silicone lubricant.

7. A building structure according to claim 1, wherein the angle of declination from said peak is at least 26 degrees.

8. A building structure according to claim 1, wherein each of said spreaders is a telescoping spreader comprising a substantially hollow bar defining a longitudinal axis of the spreader, a connector, an extension bar, and a locking assembly, said connector comprising first and second webs in substantially mutual perpendicular relation, the first web of which is adapted to be attached to said central web of an adjacent arc frame member in parallel relation therewith;

said extension bar having a web adapted to be attached to said second web of said connector in parallel relation therewith, said extension bar extending along said longitudinal axis while attached to said connector, said web of said extension bar being separate from and intermediate the opposed flanges of the adjacent arc frame member;

said hollow bar for surrounding said extension bar, said hollow bar having interior ridges defining two opposed grooves therewith adapted to accept said web of said extension bar in a sliding fit along a plane substantially longitudinally bisecting said hollow bar; and said locking assembly for fixing the position of said extension bar relative to said hollow bar.

9. A building structure according to claim 8, wherein said extension bar is a pi-shaped bar.

10. A beam intended for a building structure, said building structure comprising a plurality of arc frame members and elongate membranes, said arc frame members spaced along a length of the building structure, each of said arc frame members comprising a plurality of beams which include said beam, each of said membranes secured by its opposite longitudinal edges between an adjacent pair of said frame members in a region between the interior and exterior of the building structure, said beam comprising:

a central web extending between opposed first and second flanges, each of said flanges having two bifurcated ends, said ends defining c-shaped rope chases with openings;

means for attaching, to said central web, a spreader extending from a beam of an adjacent arc frame member for urging apart the arc frame member containing the beam from the adjacent arc frame member and for maintaining said membranes in a stretched condition;

said chases adapted for receiving said longitudinal edges, the rope chase openings of said first and second flanges being substantially angled out of the line of each flange toward the interior of the building structure in a manner so as to permit drawing said membranes through said rope chases with reduced friction during structure erection.

11. A beam according to claim 10, wherein said first and second flanges each have a similarly shaped central channel.

12. A beam according to claim 10, wherein said second flange defines two bolt channels.

13. A beam according to claim 10, wherein the ends of said first flange have a different shape than the ends of said second flange.

14. A telescoping spreader for moving apart spaced, adjacent arc frame members of a building structure, the spreader comprising:

a substantially hollow bar defining a longitudinal axis of the spreader;

a connector comprising first and second webs in substantially mutual perpendicular relation, the first web of which is adapted to be attached to a central web of an adjacent arc frame member in parallel relation therewith;

an extension bar having a web adapted to be attached to said second web of said connector in parallel relation therewith, said extension bar extending along said longitudinal axis while attached to said connected, said web of said extension bar being separate from and intermediate opposed flanges of the adjacent arc frame member;

said hollow bar for surrounding said extension bar, said hollow bar having interior ridges defining two opposed grooves therewithin adapted to accept said web of said extension bar in a sliding fit along a plane substantially longitudinally bisecting said hollow bar; and a locking assembly for fixing the position of said extension bar relative to said hollow bar.

15. A spreader according to claim 14, further comprising another extension bar, the opposed grooves of said hollow bar adapted to accept a web of said another extension bar in a sliding fit and said hollow bar additionally having two opposite ends, said extension bar being outwardly extendable from one of said ends and said another extension bar being outwardly extendable from the other of said ends.

16. A spreader according to claim 15, further comprising another locking assembly for fixing the position of said another extension bar relative to said hollow bar.

17. A spreader according to claim 16, wherein said hollow bar additionally has ribbed interior walls.

18. A building structure according to claim 8, wherein one of the opposed flanges comprises at least one channel for accepting a grapple portion of the first web of the connector.

19. A building structure according to claim 8, wherein said hollow bar additionally has ribbed interior walls.

20. A spreader according to claim 14, wherein said extension bar is pi-shaped.

21. A building structure according to claim 8, wherein said locking assembly comprises a nut and bolt assembly.

22. A building structure according to claim 8, further comprising another extension bar, the opposed grooves of said hollow bar adapted to accept a web of said another extension bar in a sliding fit and said hollow bar additionally having two opposite ends, said extension bar being outwardly extendable from one of said ends and said another extension bar being outwardly extendable from the other of said ends.

23. A building structure according to claim 22, further comprising another locking assembly for fixing the position of said another extension relative to said hollow bar.

24. A beam according to claim 10, wherein each of said spreaders comprises a substantially hollow bar defining a longitudinal axis of the spreader, a connector, an extension bar, and a locking assembly, said connector comprising first and second webs in substantially mutual perpendicular relation, the first web of which is adapted to be attached to a central web of an adjacent arc frame member in parallel relation therewith;

said extension bar having a web adapted to be attached to said second web of said connector in parallel relation therewith, said extension bar extending along said longitudinal axis while attached to said connector, said web of said extension bar being separate from and intermediate the opposed flanges of the adjacent arc frame member;

said hollow bar for surrounding said extension bar, said hollow bar having interior ridges defining two opposed grooves therewithin adapted to accept said web of said extension bar in a sliding fit along a plane substantially longitudinally bisecting said hollow bar; and said locking assembly for fixing the position of said extension bar relative to said hollow bar.

25. A spreader according to claim 14, wherein one of the opposed flanges comprises at least one channel for accepting a grapple portion of the first web of the connector.

26. A spreader according to claim 14, wherein said extension bar is pi-shaped.

27. A spreader according to claim 14, wherein said locking assembly comprises a nut and bolt assembly.

28. A building structure comprising:

a plurality of arc frame members spaced along a length of the building structure, each of said arc frame members extending from a first foot portion to a peak, and back to a second foot portion, each of said arc frame members comprising a plurality of beams, each of said beams comprising a central web extending between two opposed flanges, each of said flanges having two bifurcated ends, said ends defining c-shaped rope chases with openings;

bases adapted to be slidably mated with said first and second foot portions;

elongate membranes having beaded longitudinal edges, said membranes stretched between adjacent ones of said arc frame members, said longitudinal edges adapted to lie within said rope chases; and a plurality of spreaders each adapted to extend between adjacent ones of said arc frame members for urging apart said arc frame members from each other and for maintaining said membranes in a stretched condition, wherein each of said spreaders comprises a substantially hollow bar defining a longitudinal axis of the spreader, a connector, an extension bar, and a locking assembly, said connector comprising first and second webs in substantially mutual perpendicular relation, the first web of which is adapted to be attached to said central web of an adjacent arc frame member in parallel relation therewith;

said extension bar having a web adapted to be attached to said second web of said connector in parallel relation therewith, said extension bar extending along said longitudinal axis while attached to said connector, said web of said extension bar being separate from and intermediate the opposed flanges of the adjacent arc frame member;

said hollow bar for surrounding said extension bar, said hollow bar having interior ridges defining two opposed grooves therewithin adapted to accept said web of said extension bar in a sliding fit along a plane substantially longitudinally bisecting said hollow bar; and said locking assembly for fixing the position of said extension bar relative to said hollow bar.

29. A building structure according to claim 28, wherein the rope chase openings of both opposed flanges are substantially angled out of the line of their flange toward the interior of the building structure in a manner so as to permit drawing said membranes through said rope chases with reduced friction during structure erection.

30. A building structure according to claim 28, wherein the beams are I-beams.

31. A building structure according to claim 28, wherein one of the opposed flanges comprises at least one channel for accepting a grapple portion of the first web of the connector.

32. A building structure according to claim 28, wherein said hollow bar additionally has ribbed interior walls.

33. A building structure according to claim 28, wherein said extension bar is pi-shaped.

34. A building structure according to claim 28, wherein said locking assembly comprises a nut and bolt assembly.

35. A building structure according to claim 28, further comprising another extension bar, the opposed grooves of said hollow bar adapted to accept a web of said another extension bar in a sliding fit and said hollow bar additionally having two opposite ends, said extension bar being outwardly extendable from one of said ends and said another extension bar being outwardly extendable from the other of said ends.

36. A building structure according to claim 1, wherein the rope chase openings of both opposed flanges are substantially angled out of the line of their flange toward the interior of the building structure.

37. A building structure according to claim 8, wherein the rope chase openings of each opposed flange are substantially angled out of the line of their flange toward the interior of the building structure.

* * * * *